United States Patent [19]

Tipsword

[11] 4,202,486

[45] May 13, 1980

[54] AUTOMATICALLY SIGNALING MAILBOX

[76] Inventor: Wilbur M. Tipsword, 1603 Monroe Ave., Charleston, Ill. 61920

[21] Appl. No.: 20,417

[22] Filed: Mar. 14, 1979

[51] Int. Cl.[2] ..... A47G 29/12

[52] U.S. Cl. ..... 232/35

[58] Field of Search ..... 232/34, 35

[56] References Cited

U.S. PATENT DOCUMENTS

| | | | |
|---|---|---|---|
| 2,693,314 | 11/1954 | Hunter | 232/35 |
| 2,812,130 | 11/1957 | Abell | 232/35 |
| 2,852,185 | 9/1958 | Stouten | 232/35 |
| 2,924,376 | 2/1960 | Johnson | 232/35 |
| 3,143,286 | 8/1964 | Edge, Sr. | 232/35 |
| 3,270,956 | 9/1966 | Mullner | 232/35 |
| 3,586,235 | 6/1971 | Fishel | 232/35 |
| 3,680,524 | 8/1972 | Korinek et al. | 232/35 X |

*Primary Examiner*—William H. Schultz
*Assistant Examiner*—Peter A. Aschenbrenner
*Attorney, Agent, or Firm*—David V. Munnis

[57] ABSTRACT

Self-contained device for attachment to rural mailboxes which automatically signals when the mailbox door has been opened, including a channel support member, a signal flag pivotally connected to the channel support, a trigger element pivotally connected to the signal flag and shaped to cooperate with the channel support in setting the trigger mechanism, and separate biasing means for the signal flag and trigger element which allow the trigger mechanism to be easily set by a simple rotation of the signal flag and to be automatically released by an opening of the door of a mailbox upon which the device is mounted.

1 Claim, 4 Drawing Figures

AUTOMATICALLY SIGNALING MAILBOX

BACKGROUND OF THE PRESENT INVENTION

Mailboxes in rural areas typically are located along access roadways at distances significantly removed from mailbox owner's actual residence. Such distances, in any event, create problems in the collection of delivered mail from the mailbox to many persons, such as elderly and/or physically handicapped individuals, and to all persons in inclimate weather. To such persons a trip to an empty mailbox is not only an annoying inconvenience, but involves wasted physical hardship as well.

Many attempts to remedy this situation, involving mailbox-mounted signaling devices, have been suggested in the prior art. Such prior devices, however, in the main, have not proved in practice to be totally suitable in being too complicated and expensive to manufacture, being too complicated to operate in setting the signal trigger mechanism involved, and/or not being simply attachable to a wide variety of mailbox designs, even requiring in many cases a complete modification of the mailbox itself in violation of U.S. Post Office regulations. Other signaling devices have not enjoyed utility in requiring some operation by a mailman to trigger the signal mechanism other than simply opening the box door.

Thus, a search has continued in the art for an improved mailbox signaling device which overcomes the drawbacks of similar devices heretofore available.

OBJECTS OF THE PRESENT INVENTION

Accordingly, it is the primary object of the present invention to provide an improved mailbox signaling device which is free of the drawbacks characteristic of similar devices previously available.

Another object of the present invention is to provide an improved signaling device for rural mailboxes which is a self-contained assembly readily attachable to a rural mailbox and efficiently operable without the need to modify the existing box.

An additional object of the present inventoion is to provide an inexpensive, self-contained signaling device advantageously adapted to be readily attached to any mailbox of the rural-type having a bottom-hinged door.

A further object of the present invention is to provide an inexpensive, efficiently operating mailbox signaling device which is simple to operate in setting the trigger mechanism and consequently can be set to trigger by any individual without any special skill or tools.

Still another object of the present invention is to provide an inexpensive, simple, and efficiently operable signaling device for rural mailboxes which require no action of a mailman other than the opening of the box door.

These and other objects are achieved and are features o the sigaling device of the present invention described more fully below.

DESCRIPTION OF THE ATTACHED DRWINGS

The mailbox signaling device of the present invention will be described below in greater detail with particular reference being made to the attached drawings of which:

DESCRIPTION OF SPECIFIC EMBODIMENTS

Figure 1:
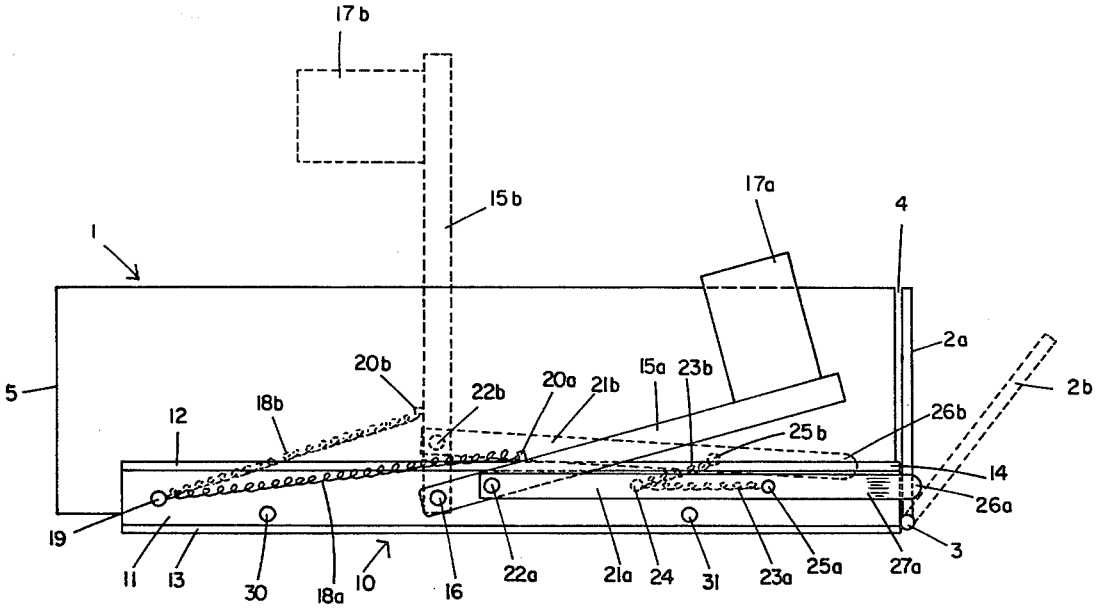
FIG. 1 is a side elevation view showing an embodiment of the signaling device of the invention mounted on a mailbox and illustrating the positions of the signal devices elements when the trigger mechanism thereof has been set and when said trigger mechanism has been released.
Figure 2:
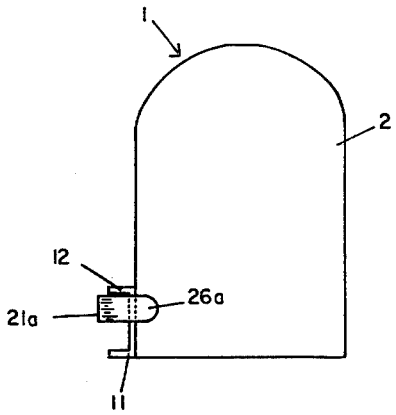
FIG. 2 is a front elevation partial view of the signaling device and box shown in FIG. 1 illustrating one aspect of the operation of the trigger mechanism of the device.
Figure 3:
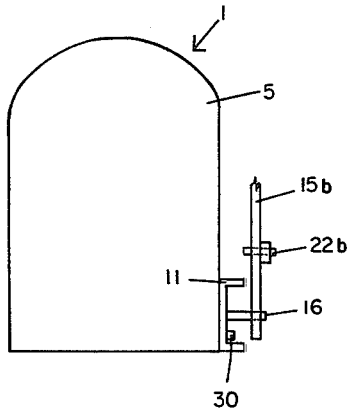
FIG. 3 is an end elevation partial view of the signaling device and box of FIG. 1 illustrating the relative position of certain elements of the trigger mechanism of the present device.
Figure 4:
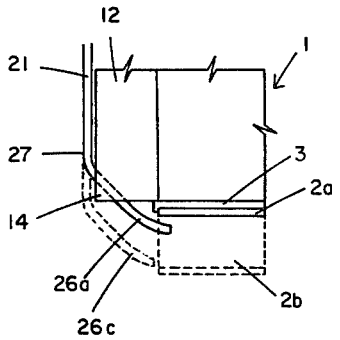
FIG. 4 is a partial top view of the signaling device and box shown in FIG. 1 illustrating the movement of the trigger latch elements.

With reference to the attached drawings numeral 1 generally designates a rural mailbox of the conventional type having a door 2 which pivots about a hinge 3 connected to its bottom in opening and closing at mouth 4 of box 1. Mounted onto box 1 with any available connecting means, such as conventional screws, nut and bolt combinations, and the like at 30 and 31 is an embodiment of the self-contained signaling device 10 of the present invention.

As shown, signaling device 10 includes elements which move when the signaling device gets in a cocked or triggerable position from a released position and vice versa. In FIG. 1 such moveable elements, when in the cocked position, are shown in solid lines and are designated by numbering including an added notation "a", and when in the triggered or released position, are shown in dotted lines and are designated by a numbering including a notation "b" or "c". Otherwise like base numbers designate the same element.

Signaling device 10 includes a channel support member 11 which is a U-shaped channel element positioned such that the flanges thereof 12 and 13 extend outwardly from the surface of box 1. A signal flag support rod 15 is pivotally connected to channel 11 at 16 by any convenient means, e.g., a nut and bolt combination, and a signal flag 17 is provided at the other end of rod 15.

Signal flag support rod 15 is biased in the direction away from door 2 of box 1 by a biasing means, e.g., spring 18 one end of which is anchored to channel 11 on the side of pivot 16 removed from door 2 and the other end of which is anchored to flap support rod 15 at 20. The tension in biasing means 18 is preselected such that when flag support rod 15 is free to rotate about pivot 16, flag 17 will assume position **17*b***.

Signal flag combination 15,17 is provided with a trigger mechanism including a trigger rod element 21 one end of which is pivotally connected by a conventional means, eg., nut an bolt combination, 22, between pivot 16 and flag 17. The other end of trigger rod element 21 entends toward door 2 and at 27 bends inwardly toward box 1 to define finger element 26 which serves as the male element of the releaseable latch assembly of the trigger mechanism. The female element of the latch assembly is provided by the lip end 14 of top flange 12 of channel 11 adjacent door 2.

Trigger rod element 21 is provided with means, eg., spring 23, biasing trigger rod 21 into channel 11 between flanges 12 and 13 thereof, such biasing being such that when trigger rod 21 is caused to move toward door 2, ie., by a rotation of flag rod 15 about pivot 16, biasing means 23 causes finger element 26 to slide under lip end 14 of flange 12, in which position finger element 26 is retained against the bottom of lip 14 due to the action of flag rod biasing means 18.

As shown finger element 26 extends, when in the latched positon 26*a*, through channel 12 and around in front of box 1 where it is adapted to engage the edge of door 2 when door 2 is in the closed positon 2*a*. Finger element 26 will stay in such position unless door 2 is opened and moved to position 2*b* at which position finger element 26 becomes deformed and caused to assume position 26*c* whereby the latch previously provided by finger 26 and lip 14 is opened and released to allow signal flag 17 to be rotated to position 17*b* by biasing means 18. As will be apparent, therefore, door 2 is the release means for the triggering mechanism of the present signaling device.

In operation and use of the signaling device of the present invention, initally installation on an existing box requires merely the connection of several means such as screws or other means 30 and 31. The attached signaling device 10 then easily can be placed in a triggerable position by closing door 2 and rotating flag rod 15 toward door 2 for a sufficient distance to cause finger element 26 and lip 14 of the latching mechanism to engage. Thereafter, when door 2 is opened, ie., by a mailman inserting mail into box 1, door 2 releases the latching mechanism and flag 17 moves to position 17*b* where it is visible from a distance as an automatic signal that box 1 has been opened. On making a trip to the so signaling box to retrieve the deposited mail, an individual, after removing the mail, merely shuts door 2 and rotates flag rod 15 to locking position 15*a* to reset the signal trigger of the instant device 10.

It will be understood that the signaling device suitably may be provide with further auxillary means, eg., stops on channel 12 to control rotation of flag 17 away from door 2, customer mailing indicators, and the like.

What is claimed is:

1. An automatic, self-contained signaling device directly attachable to mailbox having a bottom-hinged door, said device comprising a U-shaped channel member, a signal flag support rod having a signal flag attached to the upper end thereof and the lower end thereof pivotally attached to said channel member, means, anchored on the side of said signal rod pivot opposite said door of said mailbox, for biasing said signal rod toward an upright position, trigger means for said signal flag, said trigger means including a trigger rod element one end of which is pivotally connected to said signal flag rod between said signal rod pivot and said flag and the other end of which extends toward the door of said box and, adjacent said door, bends inwardly toward said box to terminate in a finger element, said finger element being shaped to be adapted to extend between the flanges of said channel member and engage the edge of said door of said box when said door is in the closed position, said trigger means also including means for biasing said trigger rod element toward said channel so as to cause said finger element to slide between said flanges of said channel member when said signal flag support rod is rotated toward said door, said finger element being latchable within the flanges of said channel member by the said two biasing means and being releaseable from said latched position by said door of said box when said door is opened, and means for connecting said device to said box.

* * * * *